United States Patent [19]

Foehl

[11] Patent Number: 4,884,302

[45] Date of Patent: Dec. 5, 1989

[54] SAFETY HELMET

[76] Inventor: Arthur Foehl, Auf der Halde 28, 7060 Schorndorf, Fed. Rep. of Germany

[21] Appl. No.: 19,219

[22] PCT Filed: Feb. 21, 1986

[86] PCT No.: PCT/DE86/00067

§ 371 Date: Jan. 12, 1987

§ 102(e) Date: Jan. 12, 1987

[87] PCT Pub. No.: WO86/04790

PCT Pub. Date: Aug. 28, 1986

[30] Foreign Application Priority Data

Feb. 23, 1985 [DE] Fed. Rep. of Germany ..... 3506495

[51] Int. Cl.[4] ..... A61F 9/00; A42B 3/02

[52] U.S. Cl. ..... 2/424; 2/427

[58] Field of Search ..... 2/9, 10, 424, 425, 427, 2/428, 429

[56] References Cited

U.S. PATENT DOCUMENTS

| | | | |
|---|---|---|---|
| 2,406,598 | 8/1946 | Flood | 2/12 |
| 2,762,051 | 9/1956 | Finken | 2/427 |
| 2,903,700 | 9/1959 | Finken et al. | 2/427 X |
| 2,915,756 | 12/1959 | Rex et al. | 2/8 |
| 3,214,767 | 11/1965 | Weber | 2/9 |
| 3,215,908 | 7/1966 | Simpson et al. | 2/9 |
| 3,605,115 | 9/1971 | Bohner | 2/10 |
| 3,774,239 | 11/1973 | Kotzar | 2/10 |
| 3,858,242 | 1/1975 | Gooding | 2/10 |
| 4,117,553 | 10/1978 | Bay | 2/10 |
| 4,462,119 | 7/1984 | Rudd | 2/429 X |
| 4,498,202 | 2/1985 | Yamamoto | 2/424 |
| 4,581,775 | 4/1986 | Nava | 2/424 |
| 4,748,696 | 6/1988 | Fohl | 2/424 |

FOREIGN PATENT DOCUMENTS

| | | |
|---|---|---|
| 2317580 | 10/1974 | Fed. Rep. of Germany . |
| 3030567 | 3/1981 | Fed. Rep. of Germany . |
| 8110871 | 3/1982 | Fed. Rep. of Germany . |
| 8325066 | 2/1985 | Fed. Rep. of Germany . |
| 8427449 | 10/1985 | Fed. Rep. of Germany . |
| 7715837 | 12/1978 | France . |

*Primary Examiner*—Wm. Carter Reynolds

*Attorney, Agent, or Firm*—Steele, Gould & Fried

[57] ABSTRACT

The safety helmet for motorcyclists includes a helmet shell and a visor for face cutout of the shell. The visor is attached to the shell in a tilting or sliding manner. The shell generally forms a U-shaped visor frame with a continuous groove into which the similarly curved, transparent visor plate is inserted and attached by spring loaded catch elements. The visor frame accommodates the visor plate only at its upper edge in a groove which is opened downwards. The two side portions of the visor plate have swing hooks which are open downwards and can be hooked into pivoting bearing points on the visor frame. At least one of the catch elements is arranged between the side ends and can be swung and locked into a catch opening provided in the visor frame.

13 Claims, 2 Drawing Sheets

Figure 4:
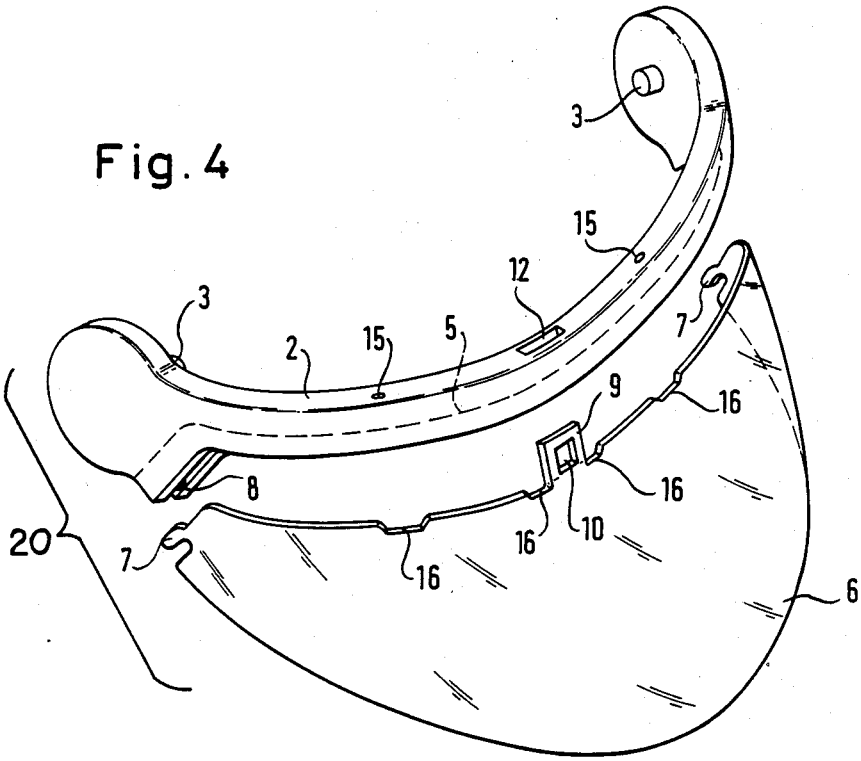

Fig.1
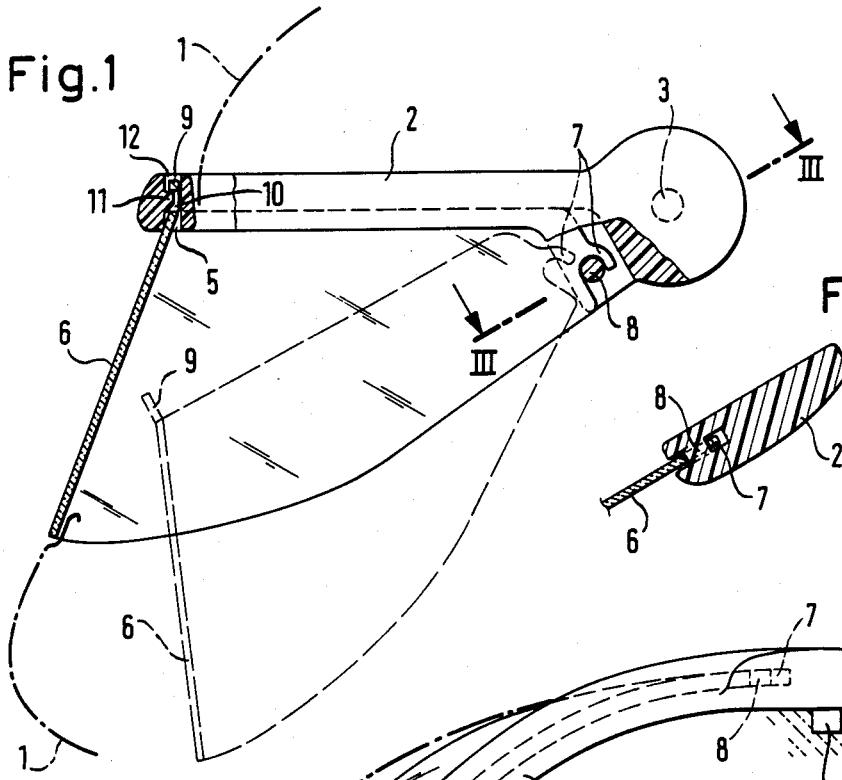
Fig.3
Fig.2
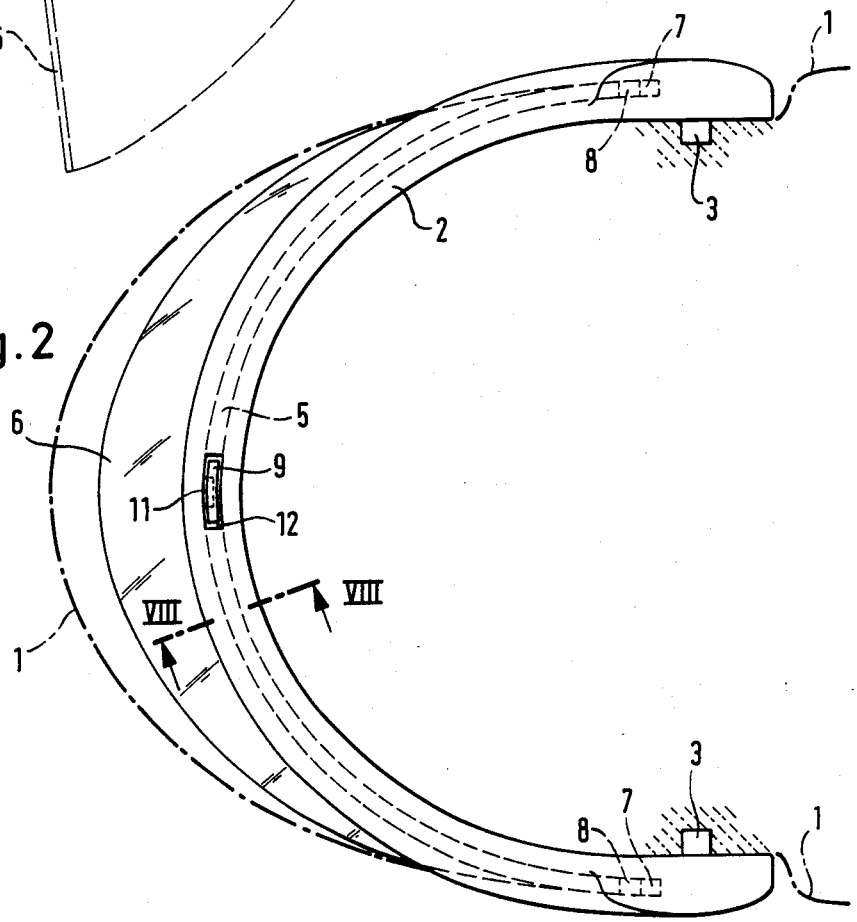

SAFETY HELMET

The invention refers to a safety helmet, particularly a crash helmet for motorcycle drivers.

Such safety helmets consist of a helmet shell provided with a cut-out for the face, whereby hinge pins are provided on both sides of the helmet shell, with bearings for a basically U-shaped face shield. This face shield can be lowered from an upper, open position into a lower position, in which it covers the face cut-out of the helmet shell. In the object of an older application, the face shield consists of a narrow, U-shaped shield frame and a transparent, also U-shaped shield plate which is provided with notch elements so that it can be inserted into a groove in the shield frame and held in place by means of the notch elements.

The purpose of the invention is to improve a safety helmet of the abovementioned nature so that the assembly, e.g. the replacement of the shield plate, is facilitated by means of a simpler construction of the related components. Further, the safety helmet should be designed so as to prevent a dimming of the shield plate, i.e. condensation of water vapor on the inside of the face shield.

Thereby that external swivel bearing points and interposed notch elements exist, there is a simple possibility to manually hook the shield plate into the swivel bearing points and then swing the shield plate upwards into its final engagement in the notch elements provided. No tools or devices are required for this purpose. Preferably, the notch point between the swivel bearing points is designed so that the disengagement of the notch connection can also be done very easily, manually or by means of very simple tools, e.g. a knife or a screwdriver, i.e. even a layman can very rapidly replace a damaged or broken shield plate. Further, the existence of aeration openings, preferably several aeration openings in the shield frame, makes it possible for the air beind the shield plate to escape upwards through the aeration openings, or, for the relative wind to flow along the inside of the shield plate and escape upwards through the aeration openings. In this manner, dimming of the inside of the shield plate is avoided with certainty.

There is a clean seal between shield plate and shield frame due to support of the shield plate on opposite groove walls of the insertion groove. In order not to obstruct the outward air flow through the aeration openings, the design provides a free opening at the upper edge of the shield plate at the level of each aeration opening, this in order to create a path for the air flow.

Figure 5:
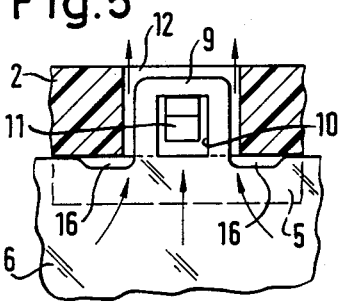
Figure 6:
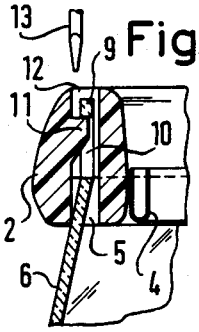
Figure 7:
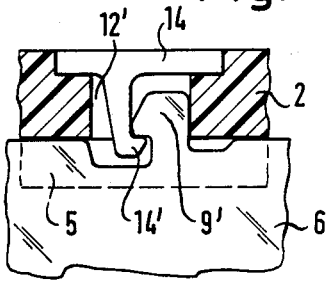
Figure 8:
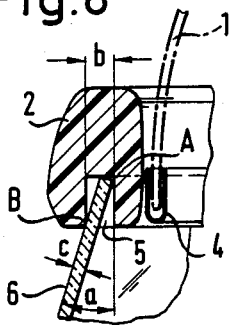
Figure 9:
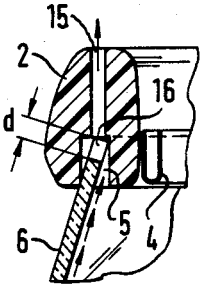
Figure 10:
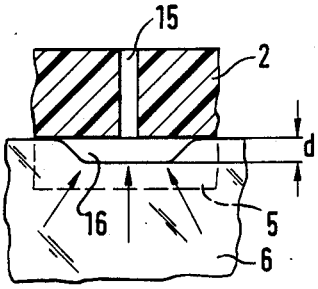

Additional advantageous details of the invention can be seen from the execution examples shown in the drawing and described in the following:

The following is shown:

FIGS. 1 and 3 the face shield for the safety helmet according to the invention, in side view and top view;

FIG. 2 a section of a detail according to FIG. 1;

FIG. 4 a perspective view of the face shield, where the shield plate is detached from the shield frame;

FIG. 5 a detail section of the center notch element;

FIG. 6 a section/side view of the detail in FIG. 5;

FIG. 7 an alternative execution of the notch connection, section;

FIG. 8 the section view of shield frame and shield plate according to the section lines in FIG. 2;

FIG. 9 the same section as in FIG. 8, in the area of an aeration opening;

FIG. 10 another, frontal section view of the shield frame and shield plate in the area of an aeration opening.

In the traditional manner, the safety helmet, which may be made of e.g. synthetic material, consists of a helmet shell, a portion of which is shown in FIG. 8 with the reference number 1, namely that shell portion which surrounds the face cut-out. This shell portion 1 can also be seen in FIG. 1. Hinged to this helmet shell 1, there is a U-shaped shield frame 2, which may also be made of a synthetic material and which engages by means of pivots 3 with corresponding swivelling elements, e.g. pivot openings, in the helmet shell 1, whereby the frame consequently has a hinged connection with the helmet shell 1. However, within the framework of the invention, it is also possible to attach the shield frame to the helmet shell in such a manner that it does not swivel. As can be seen in FIG. 8, the cut-out edge of the helmet shell is tightly engaging into a U-shaped seal 4 of the shield frame. The pivots 3 are attached on the insides of the thicker ends of the shield frame 2, e.g. they may be form-fitted as one piece. In the area of the face cut-out, the shield frame 2 is narrower and at its lower side, it has a retaining groove along the entire forward facing lower portion of the narrower area of the shield frame 2. As can be seen from FIGS. 1, 2, and 4, the detachable portion of the face shield is a transparent shield plate 6 which is also curved into a U-shape; it has no characteristic form stability. FIG. 4 shows face shield 20 including shield frame 2 and transparent shield plate 6. At both ends, this shield plate 6 has swivel hooks 7, which are formfitted in one piece to the shield plate and can be hooked into pivots or swivel profiles 8 within the retaining groove 5. As shown in FIG. 1, the shield plate is hooked into both sides of the shield frame 2 in a lowered position, shown in dashed lines—and can be lifted and arrested upwards in the position shown in solid lines in FIG. 1. For purposes of locking it in position, the shield plate 6 has a notch element 9, centered between the swivel hooks 7 and extending beyond the upper edge of the shield plate 6, said notch element having a notch recess 10, which cofunctions with a notch projection 11 inside a notch opening 12 in the shield frame. As previously mentioned, when the shield plate 6 is to be locked in with the shield frame 2, the shield plate 6 is swung upwards around the swivel bearing points 7/8, whereby the notch element 9 engages into the notch opening 12 and locks the notch recess 10 elastically to the notch projection 11. This is shown with particular clarity in FIGS. 5 and 6. Since the notch opening 12 is also open upwards, the notch connection can be very easily disconnected, manually or by means of a simple tool, e.g. a knife or a screwdriver 13, thereby that the upper edge of the elastic notch element 9 is pressed away from the notch projection and the shield plate 6 is lowered again. It is possible that in the locked position, the notch element 9 extends slightly beyond the notch opening 12, so that the abovementioned disconnection can also be made manually. As shown in FIGS. 1, 6, 8, and 9, the shield plate 6 in its locked position is inclined at an angle in relation to the retaining groove 5, which has a rectangular cross section, namely by the angle a according to FIG. 8, whereby the shield plate 6 is supported and sealed against opposite groove walls of the retaining groove 5, namely at points A and B. In this manner, additional sealing along the upper edge of the shield plate and the retaining groove 5 is rendered superfluous.

In the execution example according to FIG. 7, a clip part 14 with elastic spring effect is inserted and locked into a notch opening 12', which widens upwards, said clip part 14 being provided with a hook-like catch 14'. The notch element 9' is also designed in the form of a hook, whereby the two hook parts engage in one another when the the shield plate is closed. Even without a special attachment of the clip part, the result is a solid connection between shield plate 6 and shield frame 2 via the clip part 14, which is held in the notch opening 12' in this manner. While there is a direct clip connection in the execution example according to FIGS. 5 and 6, the clip connection is indirect in the execution example according to FIG. 7.

On such safety helmets, e.g. crash helmets for motorcycle drivers, the problem exists that e.g. the moist exhalation air condenses on the inside of the transparent shield plate, whereby the transparency is considerably reduced. In order to avoid such dimming of the shield plate 6, the invention provides basically vertical aeration openings 12 and 15 in several places, in the execution example at three positions on the shield frame. Hereby, the central notch opening is also an aeration opening. As shown particularly in FIGS. 8 and 9, the retaining groove 5 has a width b, which is greater than the thickness c of the shield plate 6. Starting at the retaining groove 5, the central notch opening 12 penetrates the shield frame 2. In the same manner, the other aeration openings 15 also penetrate the shield frame 2 in a vertical direction and open into the retaining groove 5, as shown in FIGS. 9 and 10. Since there is a sealing between the shield plate and the shield frame due to the inclined position of the shield plate 6, the shield plate 6 has free openings 16 with a depth d, in the area of the notch opening 12 and the other aeration openings 15, whereby air flow paths are created, so that the air to be evacuated behind the shield plate 6 and the fresh air flowing along the inside of the shield plate 6 as illustrated by means of arrows can exit upwards without obstructions into the open through the aeration openings 12, 15, as shown very clearly in FIG. 9. The aeration openings may be round, oval, or rectangular.

I claim:

1. Safety helmet, particularly crash helmet for motorcycle drivers, with a helmet shell and a face shield for a face cut-out in the helmet shell, which face shield has a basically U-shaped shield frame with a retaining groove along an entire forward facing lower edge length, into which groove a similarly curved, transparent shield plate can be inserted and locked by means of a spring action notch element, characterized in that the shield plate (6) has swing hooks at both its lateral ends that are rotatably hooked into bearing points (8) of the shield frame (2) and the shield plate can be pivoted into the groove and locked via a notch opening (12) on the shield frame and the notch element (9) that is located at an upper edge of the shield plate between the lateral ends of the shield plate.

2. Safety helmet according to claim 1, characterized in that the notch opening (12) originates in the retaining groove (5) of the shield frame and preferably penetrates the shield frame.

3. Safety helmet according to claim 2, characterized in that at least one notch projection (11) is provided in the notch opening (12), which locks with a notch recess (10) in the shield plate (6).

4. Safety helmet according to claim 3, characterized in that the notch element of said shield plate (6) is a first hook-like catch element, the shield frame having a second hook-like catch element located in said notch opening, said first and second catch elements engage with spring action when locked together.

5. Safety helmet according to claim 3, characterized in that the notch element (9) of the shield plate (6) reaches through at least the major portion of the notch opening (12) in the shield frame (2) and that its end can be easily detached from the notch projection (11).

6. Safety helmet according to claim 1, characterized in that said retaining groove is generally rectangular, and in its locked position, the shield plate (6) is inclined at an angle to the retaining groove (5) and is supported under initial tension against opposite groove walls so that a seal is formed.

7. Safety helmet according to claim 1, characterized in that the swing hooks are formed as one piece with said shield plate, said hooks being attachable to the bearing points which are pivot pins (8) of the shield frame (2).

8. Safety helmet as claimed in claim 1, characterized in that several basically vertical aeration openings are provided in the shield frame, which openings are open to the inside of the shield plate (6).

9. Safety helmet according to claim 1, characterized in that at least one aeration opening (12, 15) is provided in the shield frame, in the area of the retaining groove, originating in the retaining groove and penetrating the shield frame to its upper edge.

10. Safety helmet according to claim 9, characterized in that said one aeration opening is one of several aeration openings provided along the retaining groove (3).

11. Safety helmet according to claim 10, characterized in that the upper edge of the shield plate (6) is provided with a free opening (16) at the level of each aeration opening (12, 15) in order to create an air flow path.

12. Safety helmet according to claim 8, characterized in that the notch opening (12) serves as an aeration opening.

13. Safety helmet, particularly crash helmet for motorcycle drivers, with a helmet shell and a face shield for a face cut-out in the helmet shell, attached by means of hinges, which face shield has a basically U-shaped shield frame with a rectangular retaining groove along an entire forward facing lower edge length, into which groove a similarly curved, transparent shield plate can be inserted and locked by means of a spring action notch element, characterized in that the shield plate (6) has swing hooks at both its lateral ends that are rotatably hooked into bearing points (8) of the shield frame (12) and the shield plate can be pivoted and locked into a notch opening (12) of the shield frame by the notch element (9) between the lateral ends of the shield plate, wherein in a locked position, the shield plate is supported under tension against opposing groove walls.

* * * * *